United States Patent [19]

Herst et al.

[11] Patent Number: 4,573,111

[45] Date of Patent: Feb. 25, 1986

[54] LINEAR LIGHT PASSING MEDIA HAVING CERTAIN STRIPED CHARACTERISTICS

[76] Inventors: Douglas J. Herst, 11 Upper Ames, Ross, Calif. 94957; Peter Y. Y. Ngai, 1833 Fallbrook Dr., Danville, Calif. 94526

[21] Appl. No.: 596,811

[22] Filed: Apr. 4, 1984

[51] Int. Cl.[3] ..... F21V 5/00

[52] U.S. Cl. ..... 362/337; 362/340; 362/293; 362/291; 362/260; 362/223

[58] Field of Search ..... 362/217, 223, 260, 291, 362/293, 334, 335, 337, 338, 340

[56] References Cited

U.S. PATENT DOCUMENTS

| | | | |
|---|---|---|---|
| 3,348,039 | 10/1967 | Schrage | 362/22 |
| 4,390,930 | 6/1983 | Herst | 362/26 |
| 4,420,798 | 12/1983 | Herst | 362/25 |
| 4,432,044 | 2/1984 | Lautzenheiser | 362/22 |

*Primary Examiner*—Donald P. Walsh

[57] ABSTRACT

A linear light passing media, typically a linear prismatic lens or a linear diffuser strip, is provided with linear areas of coloration to give a striped effect to the media. Color or neutral stripes are provided to areas of the media that are observable by persons standing in the vicinity of the lighting fixture; they act to give the media a psychological pleasing appearance, or on linear prismatic lenses, to mask out bright strips on the prismatic surfaces or at the base of the lens.

23 Claims, 9 Drawing Figures

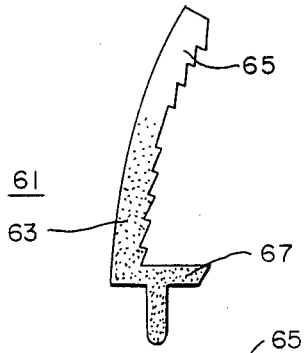
FIG—6
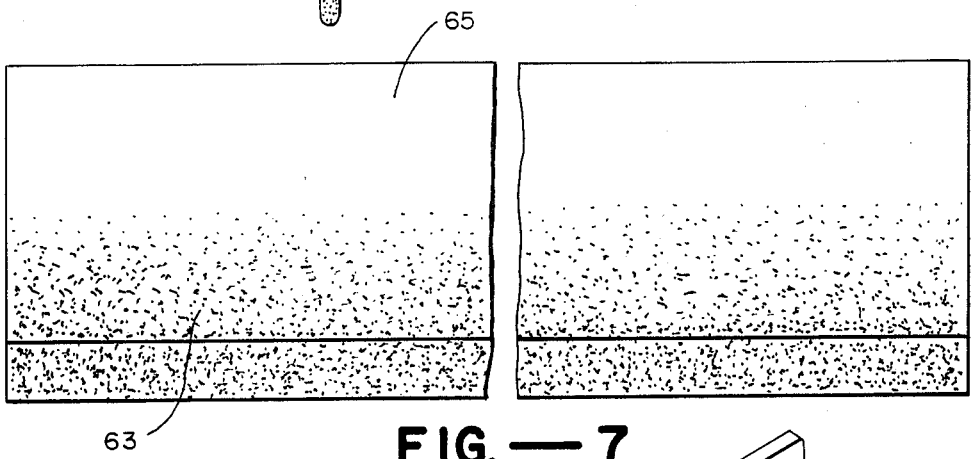
FIG.—7
FIG.—8
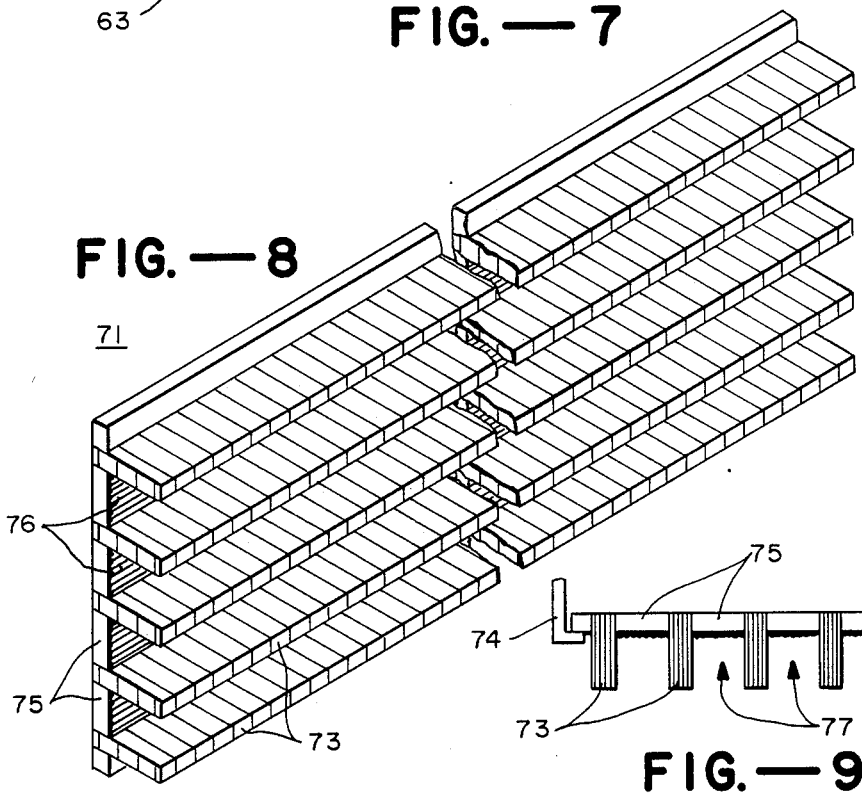
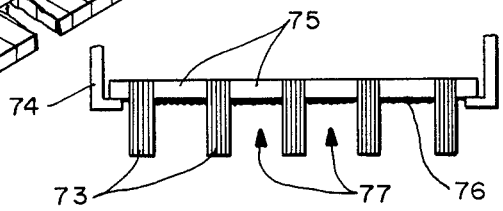
FIG.—9

LINEAR LIGHT PASSING MEDIA HAVING CERTAIN STRIPED CHARACTERISTICS

BACKGROUND OF THE INVENTION

The present invention relates to luminaires generally; it particularly relates to ceiling mounted, wall mounted, furniture mounted, suspended, or free standing luminaires having light passing media, such as light directing lenses or non-directional diffusers, wherein the media is normally seen by persons in the vicinity of the fixture.

Fluorescent luminaires of the type frequently used in office and commercial environments are characterized by a linear geometry, that is, they are elongated fixtures with a uniform cross-sectional shape. Such fixtures are commonly fabricated of steel or extruded aluminum parts, and commonly use elongated, linear plastic lenses or diffusers to mask or control light emitted from the bare fluorescent lamps. Prismatic lenses, which act to converge, diverge, or redirect light, and diffusers, which are translucent, non-directional media that pass light in a cosine distribution, have been used in direct lighting fixtures for many years. More recently lenses, and particularly linear prismatic lenses, have been adapted for use in indirect lighting fixtures where the light source is normally masked by the fixture housing itself. In the case of indirect fixtures, lenses, such as disclosed in co-pending application Ser. No. 046,970, achieve desirable indirect light distributions and are used to eliminate bright spots on wall and ceiling surfaces. They also permit the lamps to be raised within the housing for increased luminaire efficiency.

In the case of both the direct, indirect, and direct-indirect fixtures, all or a portion of the lens or diffuser surface will be seen by persons standing in view of the fixtures. The diffuser will appear as a plain white surface. The prismatic lens will, up close, display a lens pattern characterized by alternating areas of relative brightness and darkness, but further away the prismatic lens pattern will become less perceptible. The prismatic lens presents special problems in terms of visual comfort in that overly bright areas often appear at individual prism surfaces and/or along the base of the lens. Apart from these possible bright spots, the surface of a conventional prismatic lens, like that of a diffuser, appears as a substantially flat, illuminated surface with no distinguishing characteristics.

In the present invention the fixture's light passing media, be it a prismatic lens or a diffuser, is provided with unique visual characteristics at the light emitting surface of the media. The invention is intended to improve visual comfort of a fixture and permit a lighting designer to create different psychological environments through the design of the light passing media. The invention also provides, in a prismatic lens, a lens media wherein surface bright spots can be masked out.

SUMMARY OF THE INVENTION

The invention is a light passing media, such as a prismatic lens or diffuser, for a linear luminaire wherein special visual characteristics are given to the media by one or more linear coloration areas which change the transmission characteristics of the lens along this linear area. In one aspect of the invention, a plurality of linear areas of lens coloration are separated by linear areas of lens with no coloration or different coloration such that the lens has an actual striped appearance. For visual stripes, colors can be chosen to create particular psychological or visual effects, for example, blue color striping to provide a visually cool environment as compared to a red color striping for a warm environment.

In a further aspect of the invention, one or more stripes can be employed on a prismatic lens to mask normally occurring bright spots. For example, in an indirect fixture having a linear prismatic side lens, it is commonly a problem that a distracting strip of brightness appears along the transparent base of the lens adjacent the housing rim. In accorance with the invention, the bottom-most lens portion of the lens would be provided with a stripe which would act to mask out this bright area. Such a stripe could be either semi-transparent, translucent or opaque. It could also be of a neutral color and could be gradually shaded at its top edge so as to make the stripe itself practically unnoticeable to the observer; rather what the observer would see would be a prismatic lens without brightness due to the stripe.

In a still further aspect of the invention, lens coloration, preferably a neutral coloration, is provided at the mounting edge of the lens of a direct lighting fixture to prevent, in certain fixtures, undesirable housing rim reflections.

In yet another aspect of the invention, a unique comb-like lens construction is provided wherein the striping is provided by linear baffle walls separated by flat lens separators.

It is therefore seen that the primary object of the invention is to provide a light passing media having a surface which, when illuminated, is pleasing to look at and creates a desired psychological effect not produced by a conventional uniformly clear lens. A further object of the invention is to provide a linear prismatic lens having striped characteristics that reduce lens bright spots. Further objects of the invention will become apparent from the following description and claims.

DESCRIPTION OF THE DRAWINGS

FIG. 6 is an end elevational view of a side lens such as used in the indirect luminaire shown in in FIG. 4, except with a blended linear coloration area on the lens.

FIG. 7 is a front elevational view of the side lens shown in FIG. 6.

FIG. 8 is a perspective view of a comb-shaped lens in accordance with the invention.

FIG. 9 is an end elevational view of the comb-shaped lens shown in FIG. 8 positioned in a luminaire housing having a rectangular cross-sectional shape.

DESCRIPTION OF THE ILLUSTRATED EMBODIMENT

Figure 1:
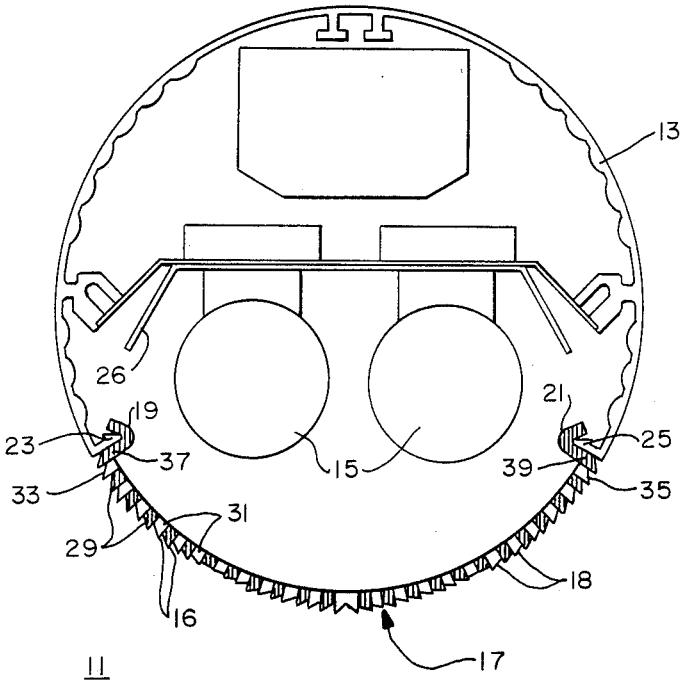
FIG. 1 is a cross-sectional view of a direct luminaire having a linear prismatic lens with color stripes in accordance with the invention.
Figure 2:
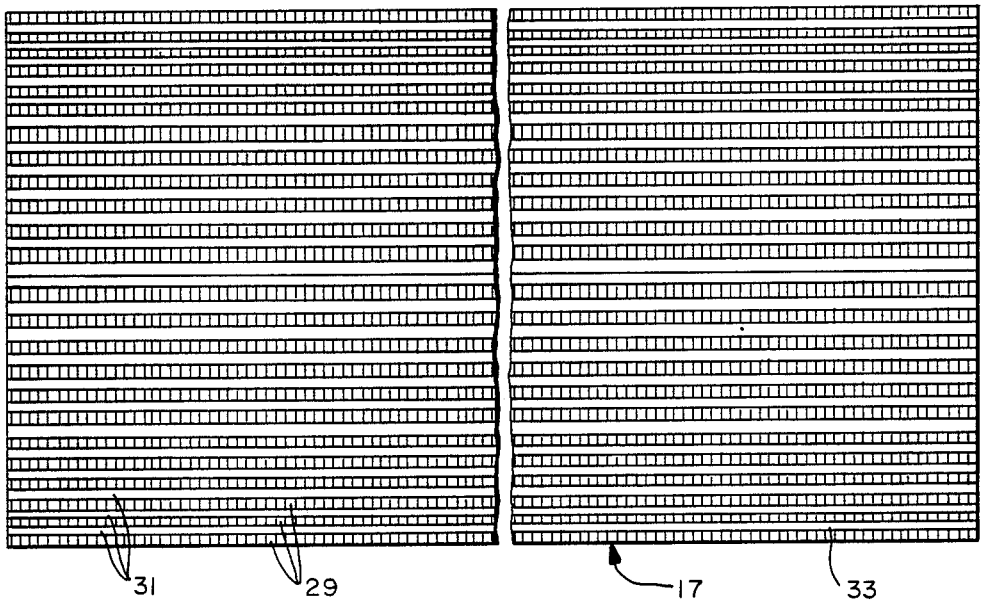
FIG. 2 is a bottom plan view of the luminaire shown in FIG. 1 showing the lens in plan view.

Reference is now made to the drawings, and particularly to the direct luminaire illustrated in FIGS. 1 and 2. The direct luminaire 11, has an elongated linear cylindrical extruded housing 13, fluorescent lamps 15 nounted within the housing, and a lens opening, shown o be a 120° lens opening, for receiving an elongated ens 17. The luminaire's light passing media is in the orm of linear prismatic lens 17 which has an exterior inear prismatic surface 18 and is attached to the housng by means of its depressable mounting edges 19, 21 ormed to snap over correspondingly retainer ribs 23, 25 ormed along the two bottom rims of the luminaire's ylindrical housing 13. It is seen that light emitted by he lamps 15 will, with the aid of reflector 26, be diected generally downwardly into the room and that he light will be redirected or disbursed by the lens' rismatic surface 18. When viewed by persons standing n the room the lens will present a luminous surface and he lamps themselves will normally not be seen.

It shall here be noted that the luminaire's light passing nedia is, in reference to FIGS. 1–5, herein described as prismatic lens wherein lens stripes can be used to mask ens bright spots. It shall be understood, however, that he stripes as hereinafter described could, in accordance vith the invention, also be applied to a linear diffuser to rovide a diffuser with a pleasing appearance and to roduce the described psychological effects. It will urther be understood that the linear geometry of the ixture and lenses specified herein can be satisfied by ny fixture or lens having a substantially uniform crossectional shape throughout its length. For example, a oughnut shape fixture would have a "linear" geometry vithin the mean of this description.

Lenses of conventional linear light fixtures are fabriated o have subbstantially uniform transparency hroughout. Uniformly transparent lenses have been abricated, for example, from clear acrylic extrusions or y injection molding. In accordance with the present nvention, and referring to the direct lighting fixture in 'IGS. 1 and 2, the lens 17, rather than being clear nroughout, has at least one linear coloration area, such s linear coloration areas 29 which, as shown, are sepaated by linear areas 31 with no lens coloration. The near areas of coloration on lens 17 are seen to present series of stripes spaced over the lens surface, stripes nat if transparent or translucent will appear as luminous stripes to an obbserver when the lamps 15 are on. As shown, each stripe spans a selected number or group f prismatic surfaces with successive stripes being sepaated by an equal number or group of prisms; thus, as hown, the transition between adjacent stripes occur at ne linear prism's riser surfaces 16. It is possible, howver, to in accordance with the invention have the tripes span unequal prism groupings. It is also possible o provide imbalanced separations between stripes, such nat the stripe boundaries fall between prism riser surices. The color stripes can be made an integral part of ne lens, such as by a known co-extrusion process vherein the lens is formed by extruding a clear and olored, or different colored, plastic material together. Alternatively the color stripes could be applied to the ens such as by taping or by a color surface coating. A urface coating might be applied by a silkscreening rocess using a transparent acrylic paint. The color elected for the stripes will depend on the particular isual and psychological effect desired by the lighting esigner. For example, the following colors can be used or the following indicated effects:

| olor | Mood or Psychological Effect |
|---|---|
| reen, blue, lavender | Cooling, relaxing, calm, |

-continued

| Color | Mood or Psychological Effect |
|---|---|
| | soothing |
| Orange, red, peach, amber | Warming, excitement, activity |
| Neutral, gray | Aesthetic contrast, visual prominence |

It should be understood that the lens stripes described herein can be transparent, semi-transparent, translucent or opaque stripes or a combination thereof. Opaque stripes would necessarily have to be interspersed with transparent stripes of colored or clear lens.

With further reference to the direct luminaire shown in FIGS. 1 and 2, the first lens surface areas 33, 35 immediately adjacent the extensions 37, 39 of the lens' mounting edge 19, 21 are preferably transparent, that is, without coloration. This, it is found, will prevent the total lens from appearing too dark. The lens' mounting edges 19, 21 are also preferably provided with a suitable opaque neutral coloration to prevent objectionable light reflections from the housing rims 23, 25 from being transmitted through the mounting edges.

Figure 3:
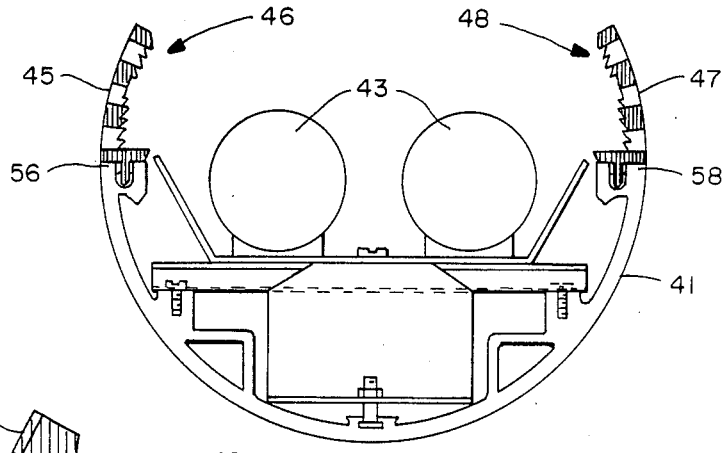
FIG. 3 is a cross-sectional view of an indirect luminaire having linear prismatic side lenses with color stripes in accordance with the invention.
Figure 4:
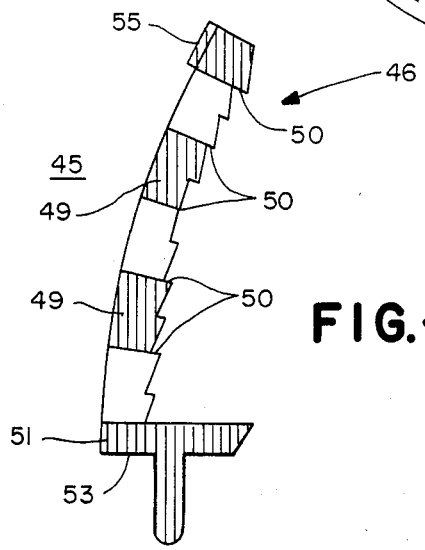
FIG. 4 is an end elevational view of the side lens of the indirect luminaire chown in FIG. 1.
Figure 5:
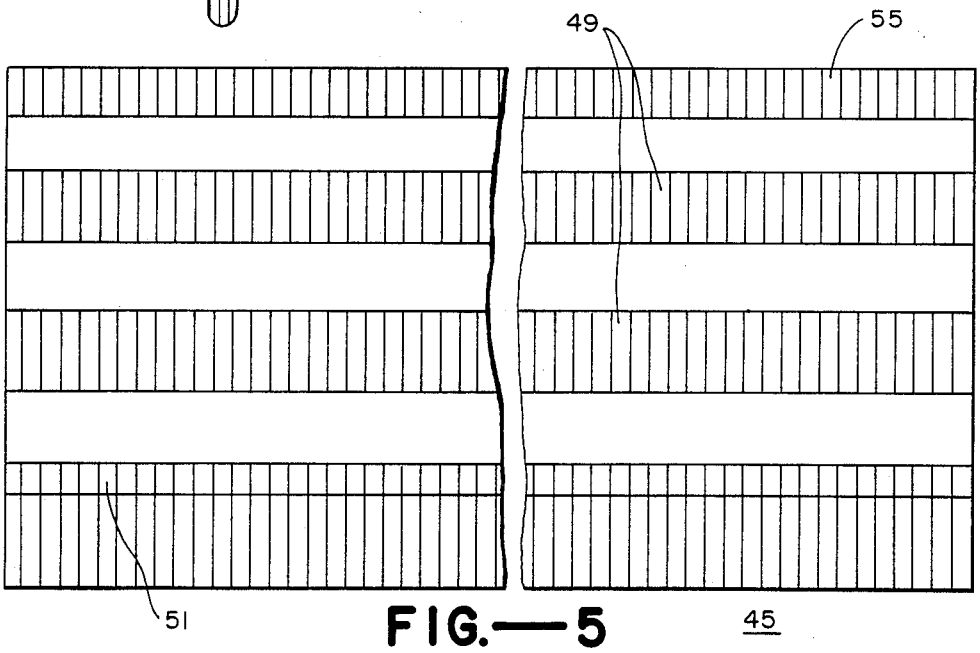
FIG. 5 is a front elevational view of the side lens shown in FIG. 4.

FIGS. 3–5 illustrate the use of the color striped lens of the present invention in connection with an indirect luminaire where normally only the side portions of the fixture lens can be seen. Referring to FIG. 3, the fixture housing 41 supports fluorescent lamps 43, and two arcuate linear prismatic side lenses 45, 47 having interior prismatic surfaces 46, 48. The side lenses are linear prismatic lenses wnhich extend the length of the fixture and, like the direct lighting fixture, can be fabricated of a plastic extrusion or by other fabrication methods such as injection molding. With reference to side lens 45 shown in FIGS. 4 and 5, the linear prismatic lens has linear coloration areas 49 which an observer sees from the side as a series of stripes which will be luminous if the stripes are transparent or translucent. As illustrated, the stripe boundaries appear at the riser surfaces 50 of the lens' interior prismating surface 46, but could appear elsewhere as well. It is seen in the case of the indirect fixture that the first color stripe 51 is preferably provided at the lens mounting edge which is in the form of lens base 54 immediately adjacent the housing support rim 56, 58. This positioning permits the first color stripe to be used to mask the bright strip of light that frequently appears along the base 54 of the lens. The color stripes, therefore, can be used to mask objectionable bright areas on the lens as well as provide the above stated psychological impressions to the observer.

As with the lens for the direct lighting fixture, the color striping in the lens for the indirect fixture can be provided by a plastic co-extrusion process or by an applied method. Also, some or all of the color stripes can be of a neutral color, particularly where masking is desired, and can be transparent, semi-transparent translucent or opaque.

It is noted that to accentuate the color striped linear lens, the stripes might be presented in relief by providing either elevated or recessed striped lens surfaces, such as the elevated striped surface 55 of the FIG. 4 lens. Such relief in a linear extruded lens can be provided for in the lens extrusion die.

With reference to FIGS. 6 and 7, a linear prismatic lens 61 for an indirect fixture, similar to the indirect fixture lens 45 shown in FIGS. 4 and 5, is provided, instead of with a series of stripes, with a single linear area of lens coloration 63 which extends along the base 65 of the lens and which, moving upwardly on the lens, gradually shades into a clear lens area 65 to produce a non-distinct edge to the stripe. This lens base stripe (shown in FIGS. 6 and 7 by strippling) can be of a neutral coloration and translucent such that the stripe itself will be practically unnoticeable to an observer of the lens; what the observer will see is a lens without apparent coloration but which has the prism brightness at the base of the lens removed. Again the lens base strips of FIGS. 6 and 7 can be applied by any of the above described fabrication processes. It is noted that a coating could suitably be coextruded on the lens to achieve the blended stripe edge.

It is further noted that the lens base stripe 63 shown in FIGS. 6 and 7 could be provided instead with a distinct edge, however, such a stripe would generally be more noticeable, which may be intended for psychological effect. The stripe could also be very narrow compared to that shown in FIGS. 6 and 7 to simply mask out the bright strip occurring right at the lens base 67; as mentioned above this strip of light is usually the most troublesome area in terms of excessive lens brightness in an indirect luminaire.

FIGS. 8 and 9 show a unique flat comb-shaped lens 71 for a direct luminaire. The comb lens 71 is formed by a series of elongated projecting linear baffle walls 73 in parallel alignment separated by relatively thin clear media strips 75. The linear baffle walls 73, which are preferably formed of a translucent material with coloration, will baffle direct light from the fixture's light source. With the baffle walls pointed downwardly in the direct luminaire as shown in FIG. 9, the baffling would normally prevent the source light from being seen directly at medium to high viewing angles (high viewing angles being angles near horizontal which are high relative to the zero degree vertical axis below the fixture.) The color baffle provided by the colored linear baffle walls 73 allow light to pass through the lens in designated directions and would give the lens a distinct striped lens appearance. It is noted that the clear media strips 75 between the baffle walls are shown as prismatic lens strips. The prismatic strips are provided for prismatic control of the baffled light, and preferably would have prismatic surfaces 76 which act to concentrate the light passing through the strips. However, the prismatic surfaces 76 of the clear media strips might also act to bend or disburse the light.

As shown in FIG. 9, the comb lens 71 can set in an elongated rectangular housing 74 of a direct luminaire with the baffle walls 73 oriented longitudinally of the housing whereby the lens baffles medium to high angle light directed laterally of the fixture. Alternatively, lens sections with the comb-like structure of FIGS. 8 and 9 can be placed crosswise in the housing 74 (so that the comb baffle walls are transversely oriented) whereby baffling of medium to high angle light occurs in a longitudinal direction.

It is contemplated that a suitable dimensioning for the comb lens 71 to achieve the object of suitably baffling high angle light would be to provide comb baffle walls of approximately $\frac{1}{8}$ inch thickness and approximately $\frac{3}{8}$ inches high with an approximately $\frac{3}{8}$ inch separation. Thus, the comb-like lens 74 of FIGS. 8 and 9 would have approximately $\frac{3}{8}$ inch square channels 77 between baffle walls 73 running the length of the lens sections. It is noted that baffling with essentially square channels 65 will shield direct light passing through a substantially horizontally disposed lens in viewing angles above approximately 45°.

It shall be understood that the above-stated dimensions of the comb lens 71 is exemplary and not intended to limit the lens to the dimensions stated. It shall also be understood that while the comb lens 71 is illustrated as a flat lens, a curved lens with radially projecting baffle walls would be an example of an alternative construction. In either case the comb baffle walls 73 would give a striped appearance to the lens as well as providing a baffle for direct light.

Therefore, it is seen that the present invention provides an improved linear lens or diffuser for a luminaire wherein striping is added to the lens surfaces to give the lens surface a desired pleasing appearance, and to give the lighting designer additional control over the visual effects produced by an overhead luminaire. The striping additionally provides, by proper location, a means for masking undesired bright spots on a prismatic lens surface or baffling direct light. It is understood that the stripes can be used selectively for the purpose of masking only or for psychological purposes only.

While the invention has been described in considerable detail in the foregoing specification, it is not intended that it be limited to such detail, except as necessitated by the appended claims.

We claim:

1. An improved linear light passing media for a linear luminaire having a luminaire housing and light source mounted in said housing, said media formed to extend longitudinally of said luminaire in a substantially uniform cross-sectional shape and comprising at least one longitudinally extending mounting edge, said mounting edge being formed for securement of said media to said luminaire housing in spaced relation to said luminaire light source, said media having linear areas of media coloration extending longitudinally of said light passing media whereby said media, when illuminated by the light source in the luminaire's housing, presents to an observer of said media a longitudinal pattern of stripes on the surface thereof.

2. The improved linear light passing media of claim 1 wherein said stripes are spaced apart by media areas with no coloration.

3. The improved linear light passing media of claim 1 wherein said media stripes are provided in relief on said media surface.

4. The improved linear light passing media of claim 1 wherein color for said stripes are selected for a desired psychological effect in terms of the visual appearance of the media.

5. An improved linear lens for a linear luminaire having a luminaire housing and light source mounted in said housing, said lens formed to extend longitudinally of said luminaire in a substantially uniform cross-sectional shape and comprising at least one longitudinally extending mounting edge, said mounting edge being formed for securement of said lens to said luminaire housing in spaced relation to said luminaire light source, a plurality of longitudinally extending linear light directing prismatic surfaces spaced in parallel relation from said mounting edge over at least a portion of the surface of said lens, said lens having selected areas of lens coloration extending along selected longitudinal prismatic surfaces whereby said lens when illuminated by the light source in the luminaire's housing presents to an observer of said lens a longitudinal pattern of stripes on the surface thereof.

6. The improved linear lens of claim 5 wherein said ens coloration areas are provided for groups of prisatic surfaces which are spaced apart by groups of rismatic surfaces with no coloration.

7. The improved linear lens of claim 6 wherein said roups of prismatic surfaces with and without lens colration each have an equal number of prismatic surices.

8. The improved linear lens of claim 6 wherein said roups of prismatic surfaces with and without lens colration have an unequal number of prismatic surfaces.

9. The improved linear lens of claim 5 wherein, for irect luminaires, no lens coloration is provided at the rst prismatic surfaces adjacent said lens mounting dge.

10. The improved linear lens of claim 8 wherein the ounting edge of said lens has lens coloration to reduce e transparency of said lens at said mounting edges.

11. The improved linear lens of claim 5 wherein sected color stripes have substanially reduced lens transarency for masking bright spots on said lens.

12. The improved linear lens of claim 11 wherein, for a indirect luminaire, a reduced transparency stripe is rovided along the lens mounting edge whereby said ripe will act to mask any bright spots occurring along uid lens mounting edge.

13. The improved linear lens of claim 5 wherein said ns color stripes are provided in relief on said lens rface.

14. An improved linear lens for a luminaire having a uminaire housing and light source mounted in said ousing, in spaced relation to said linear lens said lens omprising a plurality of elongated projecting baffle walls running in parallel substantially the length of said media, light passing media strips separating said baffle walls to form an elongated comb-like structure, said projecting baffle walls having lens coloration and said media strips having no lens coloration whereby said lens presents to the observer a series of color stripes as defined by the teeth in said comb-like structure.

15. The improved linear lens of claim 14 wherein the height and separation of said baffle walls are approximately equal.

16. The improved linear lens of claim 14 wherein said baffle walls are translucent.

17. The improved linear lens of claim 14 wherein said baffle walls are opaque.

18. The improved linear lens of claim 14 wherein said teeth are semi-transparent.

19. The improved linear lens of claim 14 wherein said media strips have light directing prismatic surfaces.

20. An improved linear prismatic lens for a linear indirect luminaire having a luminaire housing and light source mounted in said housing, said lens formed to extend longitudinally of said luminaire in a substantially uniform cross-sectional shape and comprising at least one longitudinally extending mounted edge, said mounting edge being formed for securement of said lens on said housing in spaced relation to said luminaire light source, said lens having at least one longitudinally extending, linear area of lens coloration whereby the transmission characteristics of said lens are altered along said linear area in a longitudinal pattern.

21. The improved linear prismatic lens of claim 20 wherein said linear coloration area extends along and spans at least the mounting edge of said lens to mask lens brightness thereat.

22. The improved linear prismatic lens of claim 21 wherein said linear coloration area has an upper edge which blends into clear lens area above said linear coloration area whereby the linear coloration area is less distinct.

23. The improved linear prismatic lens of claim 22 wherein said linear coloration area is of a neutral coloration.

* * * * *